US012741230B2

(12) United States Patent
Makell, III

(10) Patent No.: US 12,741,230 B2
(45) Date of Patent: Sep. 22, 2026

(54) ADJUSTABLE STARTING BLOCK SYSTEM

(71) Applicant: John Makell, III, Lexington, SC (US)

(72) Inventor: John Makell, III, Lexington, SC (US)

( * ) Notice: Subject to any disclaimer, the term of this patent is extended or adjusted under 35 U.S.C. 154(b) by 189 days.

(21) Appl. No.: 18/826,717

(22) Filed: Sep. 6, 2024

(65) Prior Publication Data

US 2026/0069997 A1 Mar. 12, 2026

(51) Int. Cl.
*A63K 3/02* (2006.01)

(52) U.S. Cl.
CPC ..... *A63K 3/023* (2013.01)

(58) Field of Classification Search
CPC ..... A63K 3/023
See application file for complete search history.

(56) References Cited

U.S. PATENT DOCUMENTS

| | | | | |
|---|---|---|---|---|
| 2,937,871 | A * | 5/1960 | McCafferty | A63K 3/023 482/19 |
| 3,724,843 | A * | 4/1973 | Fichter | A63K 3/023 482/8 |
| 5,033,738 | A * | 7/1991 | Newton, Jr. | A63K 3/023 482/19 |
| 2007/0087900 | A1* | 4/2007 | Christensen | A63K 3/023 482/19 |

FOREIGN PATENT DOCUMENTS

| | | | |
|---|---|---|---|
| CN | 216777918 | U | 6/2022 |
| CN | 220090490 | U | 11/2023 |
| CN | 117258320 | A | 12/2023 |
| CN | 220424538 | U | 2/2024 |
| CN | 118142184 | A | 6/2024 |

OTHER PUBLICATIONS

Brand: DITOSH; Title:"DITOSH Starting Blocks Multi-Function 6 Angle Adjustable Aluminum Track and Field Starting Block for Sprinting for Athletics Plastic Runway-Yellow".

* cited by examiner

*Primary Examiner* — Nathan J Flynn
(74) *Attorney, Agent, or Firm* — Jeremy A. Briggs

(57) ABSTRACT

An adjustable starting block pedal, of a starting block, having a pedal body, a retaining clip and a repositionable pin is disclosed. The retaining clip may be attached to a pedal body side surface. The retaining clip may be configured to attach the starting pedal to a rail of the starting block, and the rail may include a rail base, a plurality of slots, and teeth. The repositionable pin may be configured to be disposed between a retaining clip body and the pedal body side surface. The repositionable pin may be configured to move vertically up or down along a retaining clip body longitudinal axis, and the repositionable pin may be configured to rest at a slot bottom portion associated with the plurality of slots.

20 Claims, 5 Drawing Sheets

ADJUSTABLE STARTING BLOCK SYSTEM

TECHNICAL FIELD

The present disclosure relates to a starting block system, and more specifically to an adjustable starting block system having an adjustable pedal and a rail.

BACKGROUND

Starting blocks typically comprise angled pedals that are used by sprint athletes or runners to brace their feet against, at the start of a race. The use of starting block pedals allow the runners to push off with maximum force for the best acceleration. Starting block pedals also help the runners to put the runner's body in the proper body posture for maximum acceleration.

The starting block pedals may be positioned into tracks and the rail (part of the starting blocks) that may be placed on the ground. The rail may include slots that facilitates the pedals to securely attach with the rail. Typically, conventional pedals can be attached to specific rails (e.g., having specific teeth height, thickness, etc.), and are not customizable or adjustable to attach with rails of different dimensions.

Thus, there is a need for adjustable pedals that may be attached to different types of rails.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
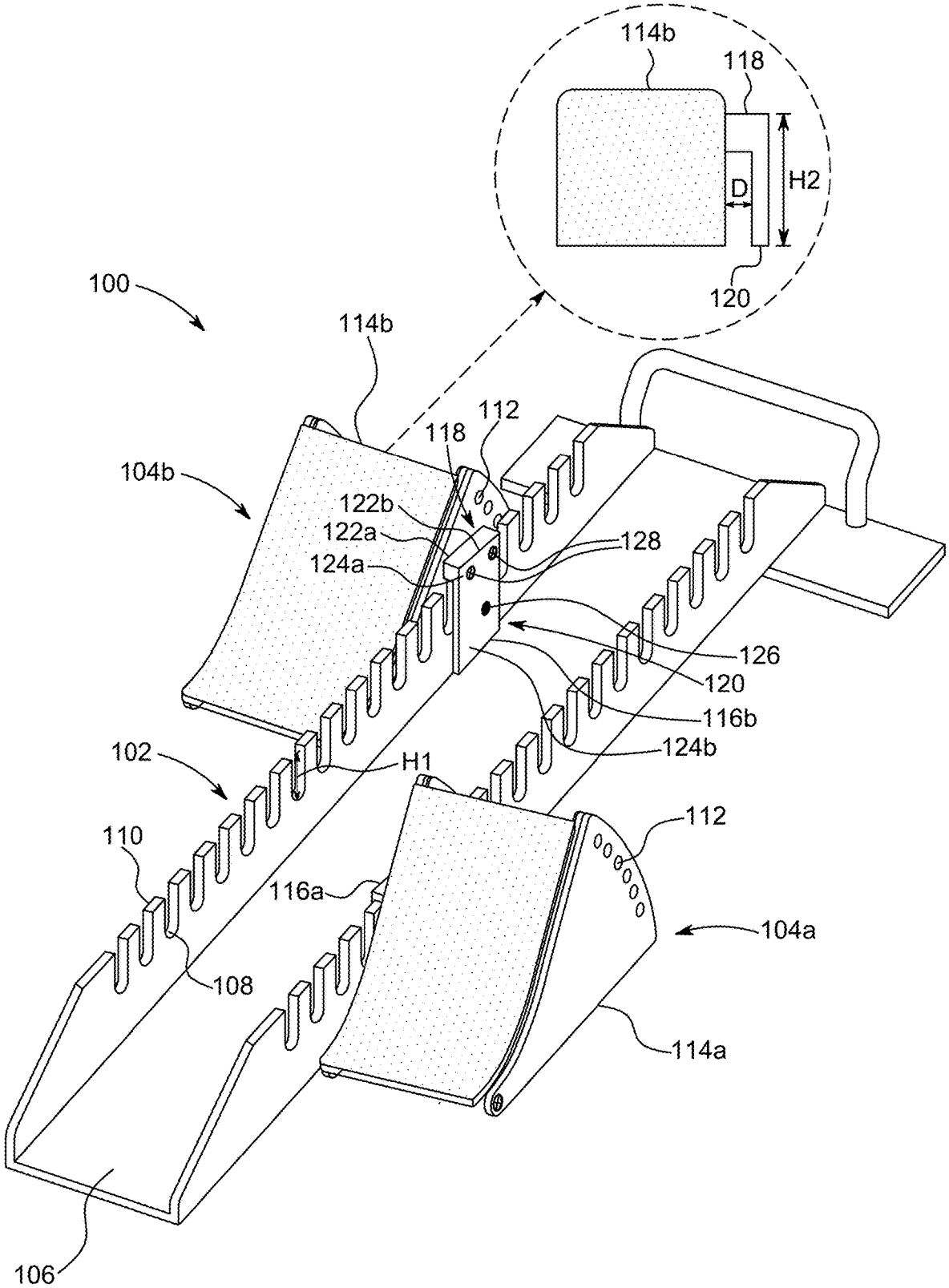
FIG. 1 depicts a first starting block system in accordance with one or more embodiments of the present disclosure.

The present disclosure is directed to an adjustable pedal that may be adjustable based on the rail type. The pedals may be configured to be attached to a rail that may include slots and teeth. The slots may be formed between adjacent teeth. Different rails may have slots/teeth of different heights and/or thicknesses. The pedals may be adjusted to accommodate the different heights and thicknesses of the slots/teeth.

In some aspects, each pedal may include a retaining clip that may be disposed on a pedal body side surface. The retaining clip may be configured to removably attach the respective pedal to the rail. The retaining clip may be an inverted "L-shaped" clip having a horizontal portion and a vertical portion. The horizontal portion may be attached to the pedal body side surface and the vertical portion may be disposed at a predetermined distance away from the pedal body side surface that may receive one or more teeth associated with the rail.

Each pedal may further include a repositioning pin that may be disposed between the retaining clip (e.g., the retaining clip's vertical portion) and the pedal body side surface. The repositioning pin may slide in a slot associated with the rail to attach the pedal with the rail. The repositioning pin may be configured to move vertically in holes disposed on the retaining clip (e.g., on the vertical portion) along a vertical portion height (or along a vertical portion longitudinal axis). The repositioning pin may be configured to position at any distance from a vertical portion top end such that the repositioning pin may rest or touch a slot bottom surface/portion and the horizontal portion may contact the top end of the teeth. In further aspects, each pedal may include more than one repositioning pin that may be positioned in different slots associated with the rail. The repositioning pin may be a post or a pull-pin.

The pedal may further include one or more attachment mechanisms that may be configured to attach the retaining clips to the pedal body side surface. In some aspects, the attachment mechanism may include screws. In some aspects, the retaining clips may include additional holes through which the screws may be repositioned vertically along the vertical portion height such that the repositioning pin may rest or touch the slot bottom surface/portion and the horizontal portion may contact the top end of the teeth.

In addition, the pedal may include a horizontal adjustment mechanism that enables the retaining clip to move laterally (e.g., away from the pedal body side surface) to change a distance between the retaining clip and the pedal body side surface (e.g., when the teeth may have a large thickness). In an exemplary aspect, the horizontal adjustment mechanism may be a spring-based mechanism.

Illustrative Embodiments

The disclosure will be described more fully hereinafter with reference to the accompanying drawings, in which example embodiments of the disclosure are shown, and not intended to be limiting.

FIG. 1 depicts a first starting block system 100 (or system 100) in accordance with one or more embodiments of the present disclosure. FIG. 1 will be described in conjunction with FIG. 2.

The system 100 may include a rail 102, and starting pedals including a first pedal 104*a*, and a second pedal 104*b*. The rail 102 may be an elongated track that may be positioned on ground (e.g., before a starting line of a race track). In some aspects, the rail 102 may be positioned on the ground by a user (e.g., a sprint athlete or runner, not shown) before the starting line of a race track. After positioning the rail 102 on the ground, the user may place/attach the pedal on the rail 102 to facilitate/assist the user in starting the run. Specifically, the pedal may facilitate the user to brace the user's feet against, at the start of a race. The pedal may enable the user to push off against the pedal with maximum force for the best possible acceleration and put the user's body in the proper body posture for maximum acceleration.

In some aspects, the rail 102 may have an elongated U-shaped body including a rail base 106, and rail sidewalls. The rail sidewalls may be perpendicular to the rail base 106, and each rail sidewall may include a plurality of slots 108 and teeth 110. The slots 108 may be formed in between two adjacent teeth 110. Specifically, adjacent teeth 110 may be disposed a predefined distance away from each other forming a "gap" between the adjacent teeth 110. The gaps that are formed between the adjacent teeth 110 are the slots 108.

In some aspects, the teeth 110 may have the same height above the rail base 106 and the same width. Further, each tooth may be disposed at the same distance from adjacent teeth. Therefore, the slots 108 may also have the same width (which may be the same as the width of the "gap" between the adjacent teeth 110) and the same height. For example, the slot 108 may have a height "H1", as shown in FIG. 1.

In some aspects, the slots 108 and the teeth 110 may be disposed along a rail sidewall length. The slots 108 and the teeth 110 may be disposed at a predetermined portion of the rail sidewall length. For example, the slots 108 and the teeth 110 may cover 50-90% of the rail sidewall length. The teeth 110 may have any length, height, width, and thickness. Further, as described above, each tooth may be disposed at an equal distance from adjacent teeth. Furthermore, the rail 102 may be made of any material. For instance, the rail 102 may be made of steel or aluminum.

As described above, the user may attach the starting block pedal (i.e., the first pedal 104*a* and the second pedal 104*b*) on the rail 102 to facilitate/assist the user in starting the run. The first pedal 104*a* and the second pedal 104*b* may be connected/attached to the rail 102 via one or more slots associated with the plurality of slots 108, to prevent slippage of the first pedal 104*a* and the second pedal 104*b* on the rail 102 during usage. The first pedal 104*a* and the second pedal 104*b* may be positioned on the opposite sides of the rail 102/rail base 106 to enable the user to push each of the user's foot against the first pedal 104*a*/second pedal 104*b*. In some aspects, the first pedal 104*a* may be a front pedal that may be disposed in proximity to a rail front portion and attached to a left rail sidewall, and the second pedal 104*b* may be a rear pedal that may be disposed in proximity to a rail rear portion and attached to a right rail sidewall, or vice versa. The first pedal 104*a* and the second pedal 104*b* may be made of any material. For instance, the first pedal 104*a* and the second pedal 104*b* may be made of steel or aluminum. In some aspects, the first pedal 104*a* and the second pedal 104*b* may include rubber pads on a front surface of the first pedal 104*a* and the second pedal 104*b* (where the user's feet touch the pedals) to provide support to the user (or runner).

In some aspects, the first pedal 104*a* and the second pedal 104*b* may be repositionable pedals that may be adjusted (e.g., the pedal front surface may be adjusted) to a variety of angles relative to the ground by the user. The pedals may be adjusted to a variety of positions by changing the angle (or tilting the pedal relative to the ground). In an exemplary aspect, the angle may range from 25 degrees to 50 degrees. For example, the user may adjust the angle to 25 degrees, 30 degrees, 35 degrees, 40 degrees, 45 degrees or 50 degrees based on user's requirement/preference. In further aspects, the angle may range from 15 degrees to 70 degrees. In some aspects, the first pedal 104*a* and the second pedal 104*b* may include a plurality of pedal slots 112 that may facilitate the user in repositioning the pedal to the desired angle. The system 100 may be used as a learning aid. The user may set the angle to 25 degrees (or a small inclination angle) when the user may be starting to use the system 100. The user may gradually increase the angle to 45 or 50 degrees when the user is proficient in using the system 100.

In some aspects, the first pedal 104*a* may include a first pedal body 114*a* and a first retaining clip 116*a* that may be attached/connected to a first pedal body side surface (e.g., at a first pedal body 114*a* exterior surface). The first retaining clip 116*a* may be configured to removably connect/attach the first pedal 104*a* to the rail 102 (specifically to the rail sidewall). In a similar manner, the second pedal 104*b* may include a second pedal body 114*b* and a second retaining clip 116*b* that may be attached to a second pedal body side surface. The second retaining clip 116*b* may be configured to attach the second pedal 104*b* to the rail 102 (specifically to the rail sidewall). In some aspects, the first pedal 104*a* and the second pedal 104*b* may be retained/attached to the rail 102 via the retaining clips 116*a*, 116*b*. The retaining clips 116*a*, 116*b* may be removably attached to the pedal 104*a*, 104*b*, via one or more attachment mechanism. The details of the attachment mechanism are described later in the description below.

In some aspects, the dimensions, shape, and material associated with the first pedal 104*a* (including the first pedal body 114*a* and the first retaining clip 116*a*) may be the same as the dimensions, shape and material associated with the second pedal 104*b* (including the second pedal body 114*b* and the second retaining clip 116*b*).

In some aspects, the retaining clips 116*a*, 116*b* may be inverted "L-shaped" clips that may be removably attached to the respective pedal body side surface. Each retaining clip 116*a*, 116*b* may include a horizontal portion 118 and a vertical portion 120 (or an elongated vertical portion). The horizontal portion 118 may touch/contact the pedal body side surface when the retaining clip 116*a*, 116*b* may be attached to the respective pedal body side surface. In some aspects, the horizontal portion 118 may be disposed parallel to the ground surface (or the rail base 106) and perpendicular to the pedal body side surface when the first pedal 104*a*/second pedal 104*b* may be attached to the rail 102, and the rail 102 is positioned on the ground. The horizontal portion 118 may include a horizontal portion distal end 122*a* and a horizontal portion proximal end 122*b*. The horizontal portion distal end 122*a* may touch the pedal body side surface when the retaining clip 116*a*, 116*b* may be attached to the respective pedal body side surface. In some aspects, the horizontal portion 118 may rest on (or touch/contact) a top end of one or more teeth when the pedals 104*a*, 104*b* may be attached to the rail 102.

The vertical portion 120 may be disposed a predetermined distance "D" away from the respective pedal body side surface to form a gap that is configured to receive one or more teeth (associated with the teeth 110). The vertical portion 120 may include a vertical portion top end 124*a* and a vertical portion bottom end 124*b*. The horizontal portion proximal end 122*b* may be attached to the vertical portion top end 124*a* to form the inverted "L-shaped" clip. Further, the vertical portion bottom end 124*b* may touch or contact the rail base 106 (e.g., a rail base top surface) or be in proximity to the rail base 106 when the first, second pedals 104*a*, 104*b* may be attached to the rail 102. The vertical portion 120 may be disposed perpendicular to the ground surface (or the rail base 106) or parallel to the pedal body side surface when the first pedal 104*a*/second pedal 104*b* may be attached to the rail 102, and the rail 102 is positioned on the ground.

Each pedal 104*a*, 104*b* may additionally include at least one repositioning pin 126 that may be disposed between the retaining clip 116*a*, 116*b* and the respective pedal body side surface. Specifically, the repositioning pin 126 may be disposed between the vertical portion 120 and the respective pedal body side surface. For example, the repositioning pin 126 may be disposed in the gap "D" between the vertical portion 120 and the pedal body side surface. The repositioning pin 126 may slide into a slot associated with the plurality of slots 108 to prevent slippage of the first pedal 104*a* and the second pedal 104*b* during use. Specifically, when the user desires to use the system 100, the user may place the pedals 104*a*, 104*b* on the rail side walls by sliding the repositioning pin 126 into the slot, such that the retaining clip 116*a*, 116*b* (specifically the horizontal portion 118) "rests" on the top end of one or more teeth and the pedals 104*a*, 104*b* are secured between the teeth and do not slide or move backwards when the user's feet push against the pedals'front surface.

In some aspects, the repositioning pin 126 may rest at a bottom portion/surface of the slot formed between adjacent teeth when the pedal 104*a*, 104*b* may be connected to the rail 102. Stated another way, the repositioning pin 126 may contact or touch the slot bottom portion/surface when the pedal 104*a*, 104*b* may be connected to the rail 102. The repositioning pin 126 may be made of any material and may be of any dimension. For instance, the repositioning pin 126 may be made of aluminum, steel, or any other material. The repositioning pin 126 may have any thickness and may have any length.

In some aspects, the repositioning pin 126 may be an adjustable pin that may be configured to be repositioned to ensure that the repositioning pin 126 securely rests on the slot bottom portion when the pedal 104*a*, 104*b* is connected to the rail 102, irrespective of the slot height "H1". Stated another way, the repositioning pin 126 be configured to be repositioned on the vertical portion 120 based on the slot height (e.g., repositioned based on whether the slot height is short or tall), such that the repositioning pin 126 securely rests at the slot bottom portion.

In some aspects, the repositioning pin 126 may be configured to be repositioned between a top vertical position, a bottom vertical position, or an intermediate vertical position between the top vertical position and the bottom vertical position along a vertical portion height "H2". Stated another way, the repositioning pin 126 may be configured to move/slide vertically up and down along a vertical portion 120 longitudinal axis or along the vertical portion height "H2" to position the repositioning pin 126 at the top vertical position, the bottom vertical position, or the intermediate vertical position. When the repositioning pin 126 may be disposed at the top vertical position on the vertical portion 120, the repositioning pin 126 may be farthest away from the rail base 106/ground or closer to the vertical portion top end 124*a* (when the pedal 104*a*, 104*b* may be attached to the rail 102). Similarly, when the repositioning pin 126 may be disposed at the bottom vertical position on the vertical portion 120, the repositioning pin 126 may be closest to the rail base 106/ground or farther from the vertical portion top end 124*a* (when the pedal 104*a*, 104*b* may be attached to the rail 102).

Figure 2:
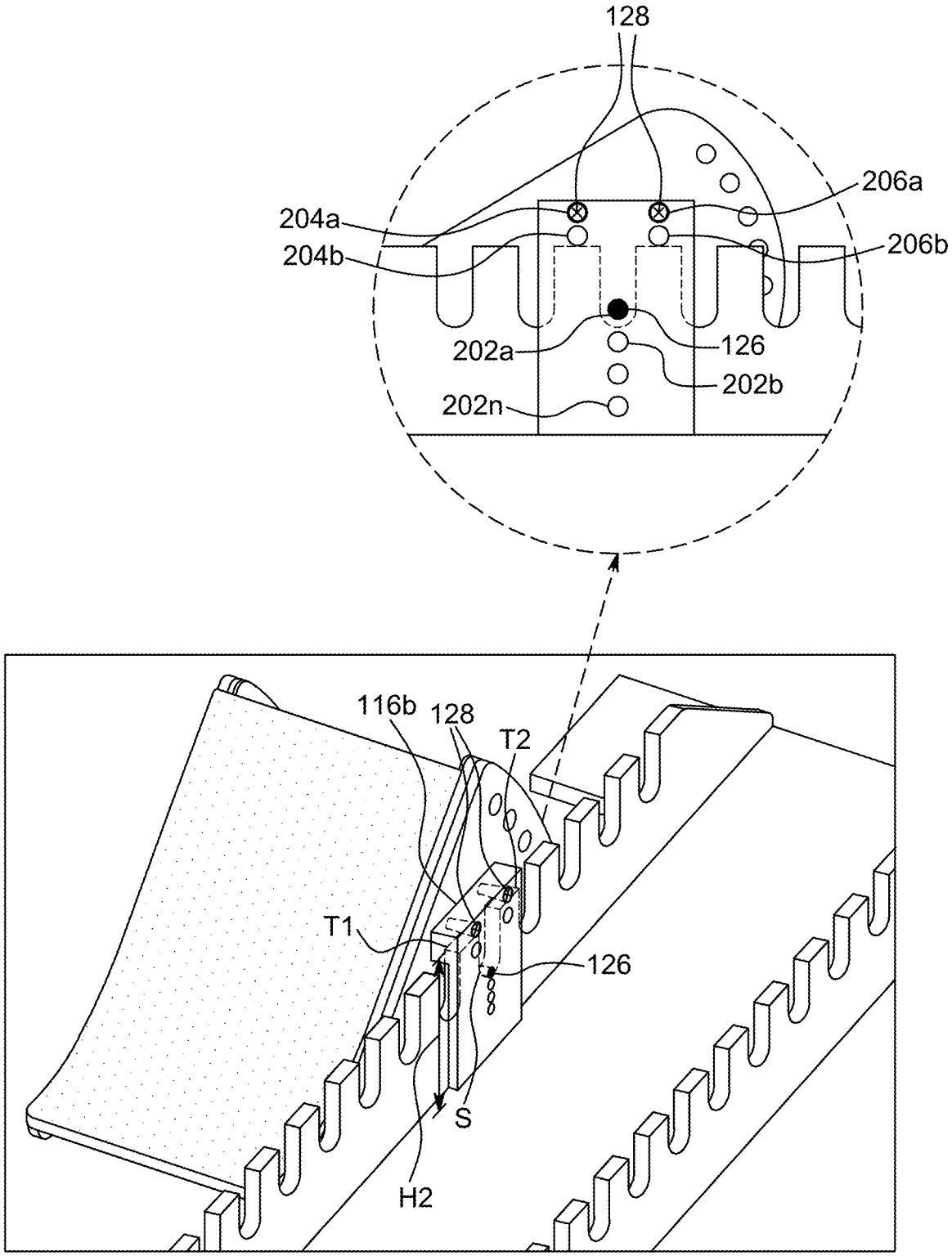
FIG. 2 depicts a connection of a pedal and rail associated with the first starting block system of FIG. 1 in accordance with one or more embodiments of the present disclosure.

In some aspects, the vertical portion 120 may include a first set of holes 202*a*, 202*b*, . . . 202*n* (collectively referred as first set of holes 202, which may be through holes disposed in the vertical portion 120 body) that may be disposed vertically along the vertical portion height "H2", as shown in FIG. 2. Specifically, the first set of holes 202 may be located between the vertical portion top end 124*a* and the vertical portion bottom end 124*b*. In the exemplary aspect depicted in FIG. 2, the hole 202*a* is closest to the vertical portion top end 124*a* (and hence farthest away from the rail base 106/ground when the pedal 104*a*, 104*b* is attached to the rail 102), and the hole 202*n* is closest to the rail base 106/ground when the pedal 104*a*, 104*b* is attached to the rail 102. In some aspects, each hole may be disposed at a predetermined and equal distance from adjacent holes. The hole 202*a* may be located above the hole 202*b*, and the hole 202*b* may be located above the hole 202*n* along the vertical portion height "H2". The holes 202 may be disposed in a straight line. In some aspects, the holes 202 may be located in a vertical portion 120 middle/center portion. In other aspects, the holes 202 may be located in a vertical portion 120 lower half. In yet another aspect, the holes 202 may be located in a vertical portion 120 upper half. The first set of holes 202 may be of any size (based on the repositioning pin 126 diameter/dimensions) and may include any count of holes (e.g., 3-10). In some aspects, the vertical portion 120 may have any other sliding mechanism to move vertically along the vertical portion height "H2".

In one exemplary aspect, the pedal 104*a*, 104*b* (specifically the side surface associated with the pedal 104*a*, 104*b* that attaches with the retaining clip 116*a*, 116*b*) may include a second set of holes (not shown) that may correspond to the first set of holes 202. For example, the count, size, and position associated with the second set of holes on the pedal 104*a*, 104*b* may correspond to the count, size and position associated with the first set of holes 202 on the vertical portion 120. The repositioning pin 126 may be configured to be disposed or slid between the vertical portion 120 and the pedal body side surface via the first set of holes 202 and the second set of holes. Specifically, the repositioning pin 126 may be configured to be engaged with one hole associated with the first set of holes 202, and a corresponding hole in the second set of holes to position the repositioning pin 126 between the pedal 104*a*, 104*b* (specifically the pedal body side surface) and the vertical portion 120 (i.e., the retaining clip 116*a*, 116*b*). The user may engage the repositioning pin 126 with a hole associated with the first set of holes 202 to position the repositioning pin 126 at the top vertical position, the bottom vertical position, or the intermediate vertical position, based on the slot dimensions/height "H1". For instance, the repositioning pin 126 may be in the top vertical position when the repositioning pin 126 may be engaged with the hole 202*a* or a top hole (from the first set of holes 202) and the corresponding hole in the pedal 104*a*, 104*b* (e.g., from the second set of holes). Similarly, the repositioning pin 126 may be in the bottom vertical position when the repositioning pin 126 may be engaged with the hole 202*n* or a bottom hole (from the first set of holes 202) and the corresponding hole in the pedal 104*a*, 104*b* (e.g., from the second set of holes).

In other aspects, the pedal 104*a*, 104*b* (specifically the pedal 104*a*, 104*b* side surface that attaches with the retaining clip 116*a*, 116*b*) may not include the second set of holes as described above. In this case, the repositioning pin 126 may just get inserted into the first set of holes 202, and may not require the second set of holes to securely rest on the slot bottom portion.

As described above, the repositioning pin 126 may rest on the slot bottom portion when the repositioning pin 126 may be positioned at the top vertical position, the bottom vertical position, or the intermediate vertical position based on a slot height "H1". Stated another way, the repositionable pin 126 may be positioned at the top vertical position, the bottom vertical position, or the intermediate vertical position to ensure that the repositioning pin 126 securely rests on the slot bottom portion (by engaging the repositioning pin 126 with appropriate holes as described above). In some aspects, the horizontal portion 118 may be configured to rest on a top end of one or more teeth of the teeth 110, when the repositioning pin 126 may be positioned at the top vertical position, the bottom vertical position, or the intermediate vertical position. Stated another way, the repositioning pin 126 may be positioned at the top vertical position, the bottom vertical position, or the intermediate vertical position to ensure that the horizontal portion 118 rests on the top end of one or more teeth of the teeth 110 (in addition to ensuring that the repositioning pin 126 securely rests on the slot bottom portion). In some aspects, the repositioning pin 126 may be a pull-pin that may be configured to engage with the different holes described above to position the repositioning pin 126 at the top vertical position, the bottom vertical position, or the intermediate vertical position, depending on the slot height "H1".

The pedal 104*a*, 104*b* may further include one or more attachment mechanisms that may be configured to attach the retaining clip 116*a*, 116*b* (e.g., the vertical portion 120 and/or the horizontal portion 118) to the pedal body 114*a*, 114*b* (specifically the pedal body side surface). In some aspects, the pedal 104*a*, 104*b* may include one or more screws 128 that may enable attachment between the retaining clip 116*a*, 116*b* and the pedal body 114*a*, 114*b*. In some aspects, the vertical portion 120 and the pedal body side surface may include holes through which the screws 128 may attach the retaining clip 116*a*, 116*b* to the pedal body 114*a*, 114*b*. In other aspects, the horizontal portion 118 and the pedal body side surface may include holes through which the screws 128 may attach the retaining clip 116*a*, 116*b* to the pedal body 114*a*, 114*b*.

For example, as shown in FIG. 2, the vertical portion 120 may include a third set of holes 204*a*, 204*b* (collectively referred as third set of holes 204) and/or a fourth set of holes 206*a*, 206*b* (collectively referred as fourth set of holes 206) that may be disposed vertically along a vertical portion height (similar to the arrangement of the first set of holes 202 on the vertical portion 120). The screws 128 may be positioned at a top vertical position, a bottom vertical position, or any intermediate vertical position between the top vertical position and the bottom vertical position via the third set of holes 204 and the fourth set of holes 206, like the repositioning pin 126. The screws 128 may be positioned in different holes (e.g., a first hole associated with the third set of holes 204 and a first hole associated with the fourth set of holes 206) to adjust the distance between the screws 128 and the repositioning pin 126 such that the repositioning pin 126 may rest on the slot bottom portion and the horizontal portion 118 may rest on (or touch/contact) the top end of one or more teeth. For example, as shown in FIG. 2, the horizontal portion 118 rests on teeth T1 and T2, and the repositioning pin 126 rests on the bottom portion of a slot "S" when the screws 128 are positioned via the holes 204*a* and 206*a* and the repositioning pin 126 is positioned via the hole 202*a*.

It may be appreciated from the description above by positioning the screws 128 in different holes from the third and fourth set of holes 204, 206, the user may reposition the retaining clip 116*a*, 116*b* vertically along a pedal body height. For example, when the user desires to move the retaining clip 116*a*, 116*b* upwards away from the rail base 106 (e.g., when the teeth height may be large), the user may reattach the retaining clip 116*a*, 116*b* by repositioning the screws 128 via a second hole (e.g., the hole 204*b*) associated with the third set of holes 204 and a second hole (e.g., the hole 206*b*) associated with the fourth set of holes 206.

The third set of holes 204 and the fourth set of holes 206 may be located between the vertical portion top end/surface and the vertical portion bottom end/surface. Each hole associated with the third set of holes 204 may be disposed at a predetermined equal distance from adjacent holes associated with the third set of holes 204. Similarly, each hole associated with the fourth set of holes 206 may be disposed at a predetermined equal distance from adjacent holes associated with the fourth set of holes 206.

When the third, fourth set of holes 204, 206 are disposed on the vertical portion 120, the third set of holes 204 and the fourth set of holes 206 may be located in the vertical portion upper half. In some aspects, the third set of holes 204 may be located towards a vertical portion left edge, and the fourth set of holes 206 may be located towards a vertical portion right edge.

Furthermore, the third set of holes 204 and the fourth set of holes 206 may be disposed parallel to each other so that the screws 128 may be aligned with each other to efficiently secure the retaining clip 116*a*, 116*b* to the pedal body 114*a*, 114*b*. The third set of holes 204 and the fourth set of holes 206 may be of any size and may include any count of holes (e.g., 2-8).

In operation, the user may attach the pedal 104*a*, 104*b* to the rail 102, by sliding the repositioning pin 126 in the slot as described above. The user may then adjust the position of the repositioning pin 126 and/or the screws 128 (if required) based on the slot height. Specifically, when the rail 102 includes slots of short height, the repositioning pin 126 may be positioned closer to the screws 128 such that the repositioning pin 126 may rest on the slot bottom portion and the horizontal portion 118 may rest on (or touch/contact) the top end of one or more teeth. For example, in this case, the repositioning pin 126 may be positioned at the top vertical position (e.g., via the top hole associated with the first set of holes 202) and the screws 128 may be positioned at the top vertical position, the bottom vertical position, or the intermediate vertical position (via the third set of holes 204 and the fourth set of holes 206) such that the distance between the horizontal portion 118 bottom surface and the repositioning pin 126 may become equivalent to the slot height.

Similarly, when the rail 102 includes slots of long height, the repositioning pin 126 may be positioned farther from the screws 128 such that the repositioning pin 126 may rest on the slot bottom portion and the horizontal portion 118 may rest on (or touch/contact) the top end of one or more teeth. In this case, the user may vertically move down the repositioning pin 126 from the top vertical position to the bottom vertical position or the intermediate vertical position such that the distance between the horizontal portion 118 bottom surface and the repositioning pin 126 may be equivalent to the slot height. In some aspects, the screws 128 may be reattached/reengaged with other holes associated with the third set of holes 204 and the fourth set of holes 206 such that the distance between the horizontal portion 118 bottom surface and the repositioning pin 126 may become equivalent to the slot height. In this manner, the retaining clip 116*a*, 116*b* may be adjusted to accommodate different slot heights. Since the slot heights are based on the teeth height, a person ordinarily skilled in the art may appreciate that the retaining clip 116*a*, 116*b* may thus enable the user to use the pedal 104*a*, 104*b* with rails of different dimensions (or different teeth height), without needing to require different sets of pedals for different rails.

Figure 3:
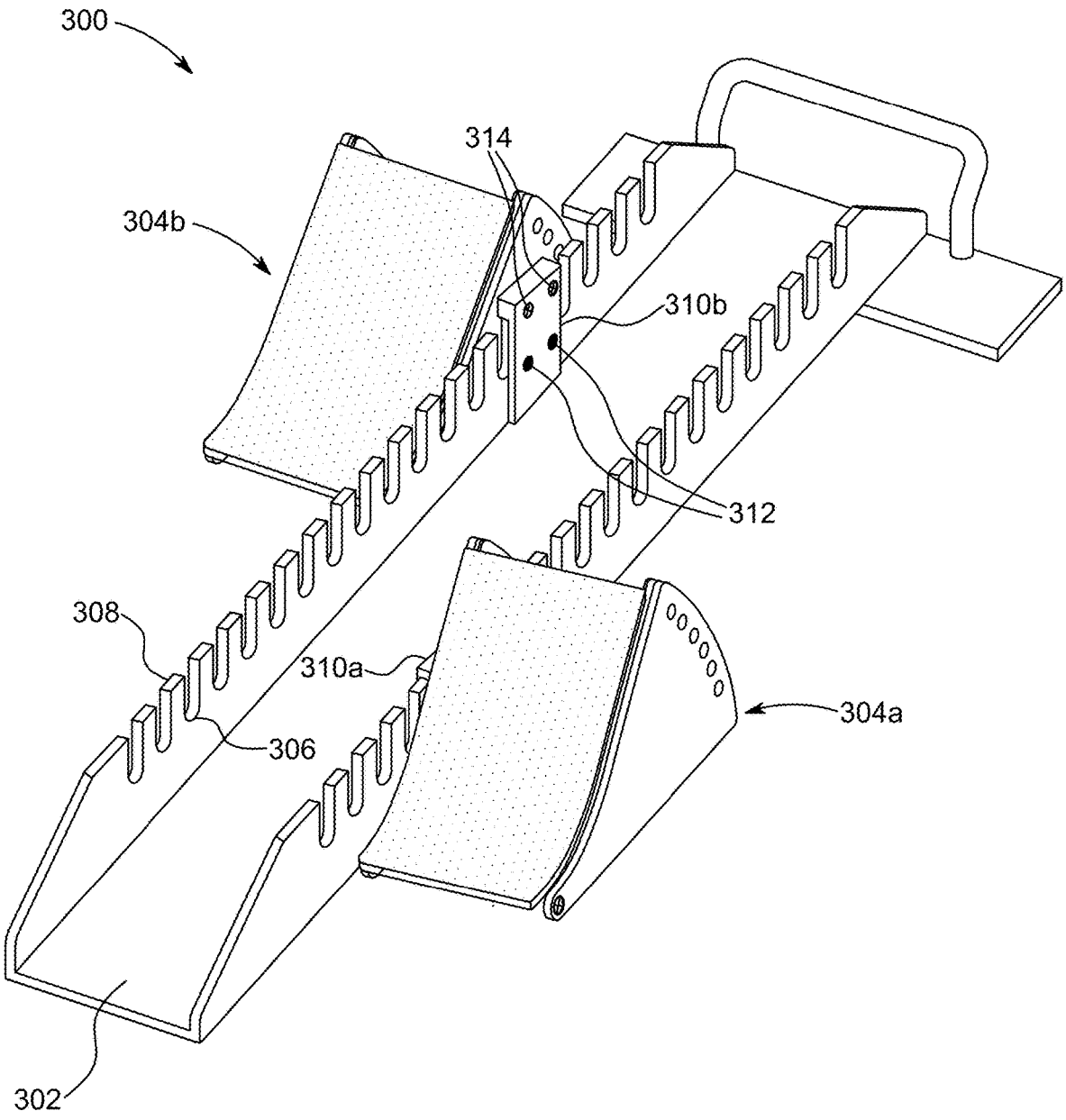
FIG. 3 depicts a second starting block system in accordance with one or more embodiments of the present disclosure.
Figure 4:
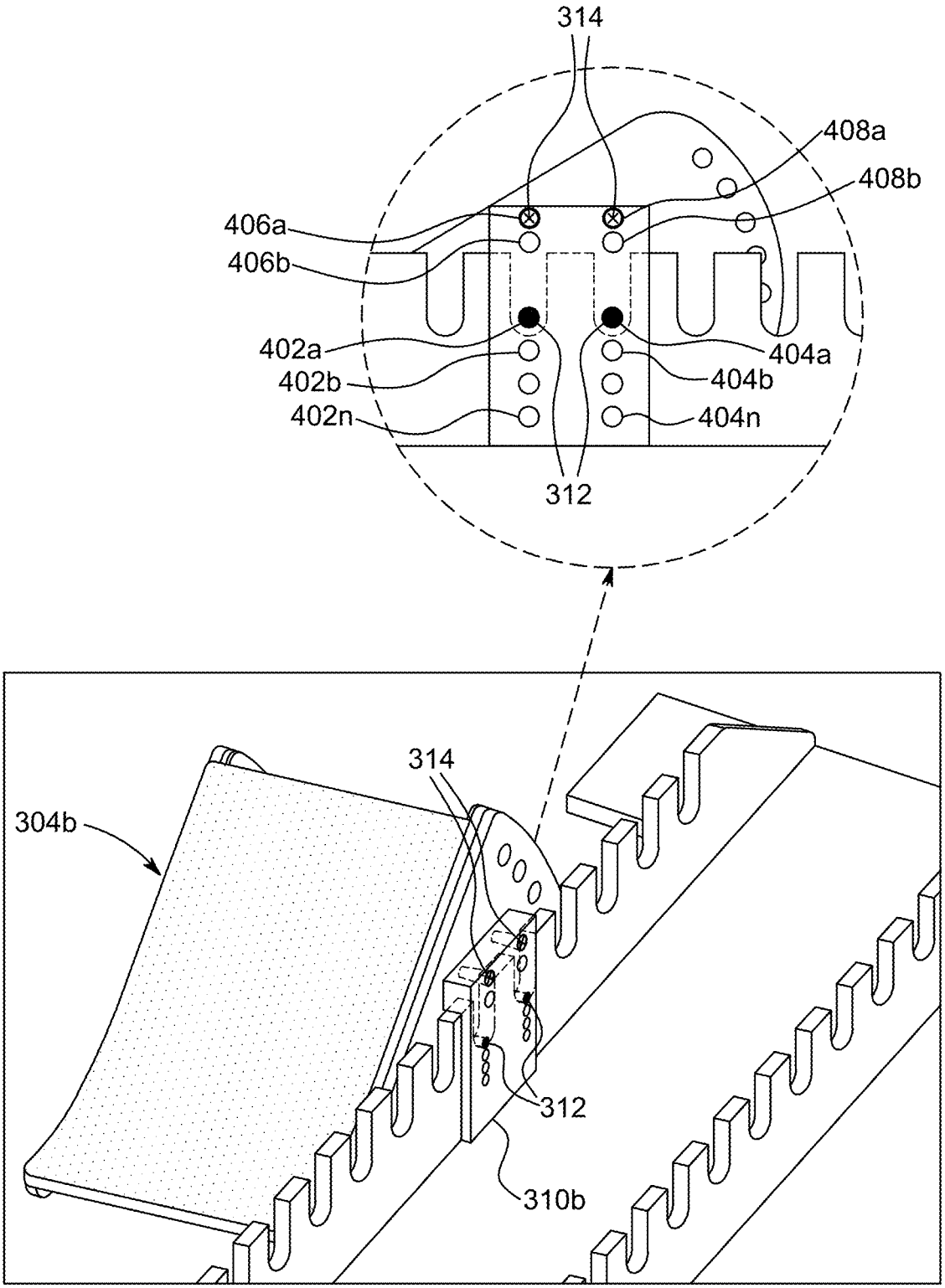
FIG. 4 depicts a connection of a pedal and rail associated with the second starting block system of FIG. 3 in accordance with one or more embodiments of the present disclosure.

FIG. 3 depicts a second starting block system 300 (or system 300) in accordance with one or more embodiments of the present disclosure. FIG. 3 will be described in conjunction with FIG. 4.

The structure/components of the system 300 may be similar to the structure/components of the first starting block system 100. The system 300 may include a rail 302, a first pedal 304*a*, and a second pedal 304*b*. The rail 302 structure may be similar to the rail 102 structure, and the pedals 304*a*, 304*b* structure may be similar to the pedals 104*a*, 104*b* structure. The rail 302 may include a plurality of slots 306 and teeth 308. Each pedal 304*a*, 304*b* may include a first retaining clip 310*a* and a second retaining clip 310*b*.

In some aspects, the retaining clips 310*a*, 310*b* may include two repositioning pins 312 instead of one repositioning pin 126 described above in conjunction with FIG. 1, and one or more attachment mechanism (e.g., screws 314 similar to the screws 128). The structure and functioning of the repositioning pins 312 may be similar to structure and functioning of the repositioning pin 126. The repositioning pins 312 may be configured to rest (or touch) on a bottom portion of different slots. For example, one repositioning pin may be positioned in a first slot (associated with the plurality of slots 306) and another repositioning pin may be positioned in a second slot (associated with the plurality of slots 306). The retaining clips 310*a*, 310*b* may include any count of repositioning pins and is not limited to one or two repositioning pins.

Furthermore, the retaining clips 310*a*, 310*b* may include a first set of holes 402*a*, 402*b*, . . . 402*n* (collectively referred as first set of holes 402) and a second set of holes 404*a*, 404*b*, . . . 404*n* (collectively referred as first set of holes 404). The first set of holes 402 and the second set of holes 404 may be similar to the first set of holes 202 described above in conjunction with FIG. 2. The first set of holes 402 may be parallel to the second set of holes 404 so that the two repositioning pins 312 may be aligned with each other when the repositioning pins 312 rest on two different slots. The repositioning pins 312 may be positioned in the top vertical position, the bottom vertical position, and the intermediate vertical position using the first set of holes 402 and the second set of holes 404 in the same manner as the repositioning pin 126 is positioned in the first set of holes 202.

In some aspects, the retaining clips 310*a*, 310*b* may include a third set of holes 406*a*, 406*b* (collectively referred as third set of holes 406) and a fourth set of holes 408*a*, 408*b* (collectively referred as fourth set of holes 408). The third set of holes 406 and the fourth set of holes 408 may be similar to the third set of holes 204 and the fourth set of holes 206, through which the screws 314 may be repositioned as described above in conjunction with FIG. 1.

In operation, the user may attach the pedals 304*a*, 304*b* to the rail 302 by aligning the two repositioning pins 312 with two different slots such that the two repositioning pins 312 may be inserted in the two different slots. The user may then adjust the position of the two repositioning pins 312 and the screws 314 like the repositioning pin 126 and the screws 128, such that the repositioning pins 312 may rest on (or touch) the bottom portion of different slots and the retaining clips 310*a*, 310*b* (e.g., horizontal portions associated with the retaining clips 310*a*, 310*b*) may rest on the top end of the teeth 308. The two repositioning pins 312 may share the force applied to the pedals 304*a*, 304*b* during use.

Remaining structural and functional details associated with the system 300 is same as the structural and functional details associated with the system 100, and hence not described again here for the sake of simplicity and conciseness.

Figure 5:
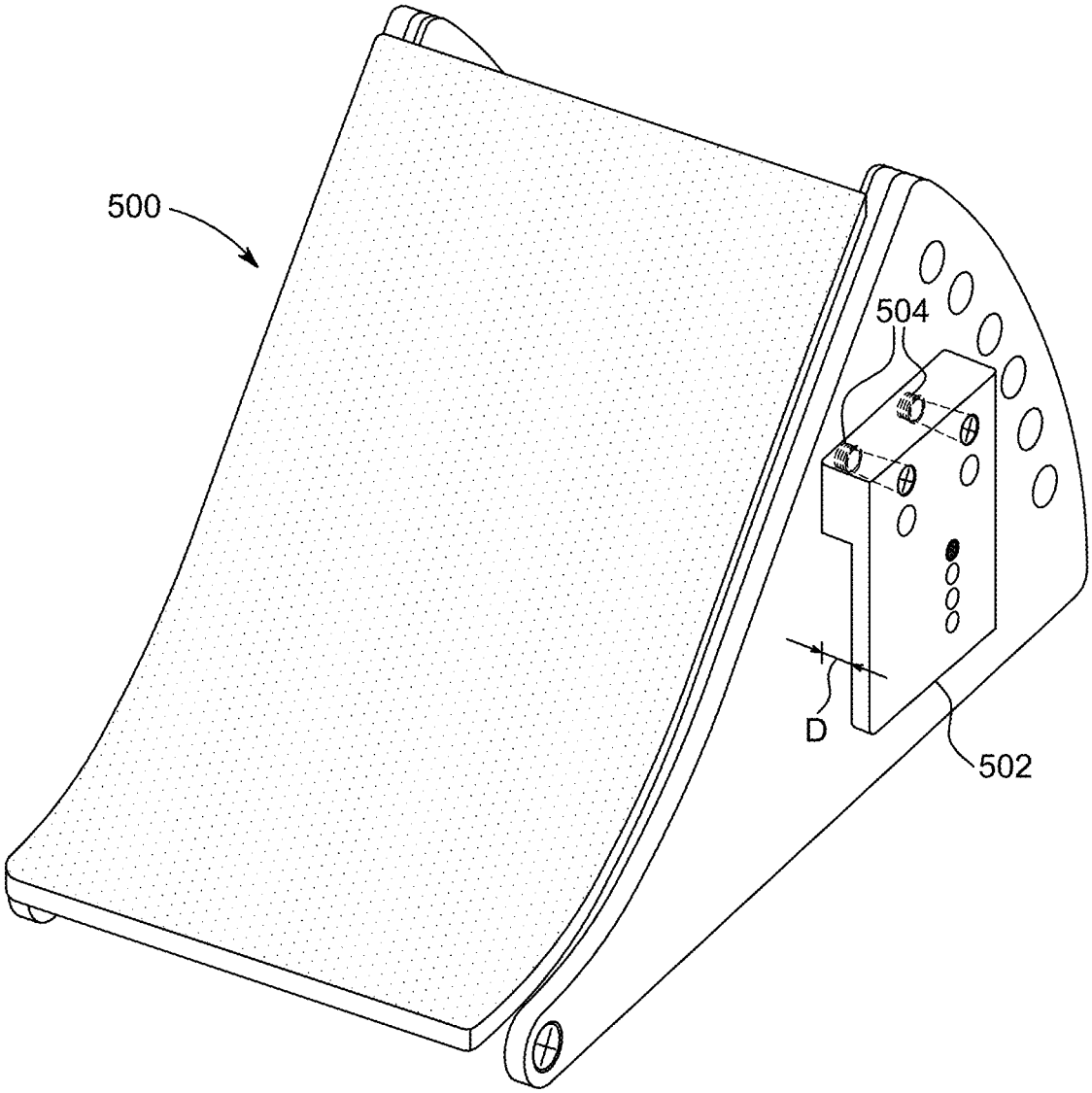
FIG. 5 depicts an exemplary pedal with a retaining clip in accordance with one or more embodiments of the present disclosure.

FIG. 5 depicts an exemplary pedal 500 with a retaining clip 502 in accordance with one or more embodiments of the present disclosure. The pedal 500 structure may be same as the pedals 104*a*, 104*b*, 304*a*, 304*b* structure described above, and the retaining clip 502 structure may be similar to the retaining clips 116*a*, 116*b*, 310*a*, 310*b* structure described above.

In some aspects, the retaining clip 502 may include a horizontal adjustment mechanism that enables the retaining clip 502 to move laterally (e.g., away from the pedal body side surface) to change a distance between the retaining clip 502 and the pedal body associated with the pedal 500. In particular, the horizontal adjustment mechanism may enable the user to increase the distance "D" between vertical portion associated with the retaining clip 502 and the pedal body side surface. The user may increase the distance "D" when the teeth 110, 308 are relatively thick.

In some aspects, the horizontal adjustment mechanism may include a spring-based mechanism 504. For instance, the horizontal adjustment mechanism may include one or more springs or may include a spring loaded screw (that may attach the retaining clip 502 and the pedal body side surface) that may allow the horizontal/lateral movement of the retaining clip 502 relative to the pedal body side surface to adjust/increase the distance "D". The springs may be positioned anywhere in the pedal 500. In some aspects, the springs may be located between the retaining clip 502 and the pedal body side surface. In some aspects, the spring-based mechanism may be attached to the retaining clip 502 and the pedal body side surface. In further aspects, the spring-based mechanism may be located between the horizontal portion distal end 122*a* and the pedal body side surface.

Remaining details of the pedal 500 are same as the details of the pedals 104*a*, 104*b*, 304*a*, 304*b* described above, and hence are not described again here for the sake of simplicity and conciseness.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A starting block pedal of a starting block comprising:

a pedal body;

a retaining clip attached to a pedal body side surface, wherein the retaining clip is configured to attach the starting pedal to a rail of the starting block, and wherein the rail comprises a rail base, a plurality of slots, and teeth; and a repositionable pin configured to be disposed between a retaining clip body and the pedal body side surface, wherein the repositionable pin is configured to move vertically up or down along a retaining clip body longitudinal axis, and wherein the repositionable pin is configured to rest at a slot bottom portion associated with the plurality of slots.

2. The starting block pedal of claim 1, wherein the repositionable pin is configured to position at a top vertical position, a bottom vertical position, or an intermediate vertical position between the top vertical position and the bottom vertical position, and wherein the repositionable pin is configured to rest at the slot bottom portion when the repositionable pin is positioned at the top vertical position, the bottom vertical position, or the intermediate vertical position based on a slot height.

3. The starting block pedal of claim 2, wherein the retaining clip is an inverted "L-shaped" clip having a horizontal portion and a vertical portion, and wherein the horizontal portion is parallel to ground and the vertical portion is perpendicular to the ground when the starting block pedal is placed on the ground.

4. The starting block pedal of claim 3, wherein the horizontal portion touches the pedal body side surface when the retaining clip is attached to the pedal body side surface, and wherein the vertical portion is disposed a predetermined distance away from the pedal body side surface to form a gap that is configured to receive one or more teeth.

5. The starting block pedal of claim 3, wherein:

the horizontal portion comprises a horizontal portion distal end and a horizontal portion proximal end, the vertical portion comprises a vertical portion top end and a vertical portion bottom end, the horizontal portion distal end touches the pedal body side surface when the retaining clip is attached to the pedal body side surface, and the horizontal portion proximal end is attached to the vertical portion top end to form the inverted "L-shaped" clip.

6. The starting block pedal of claim 5, wherein the horizontal portion is configured to rest on a top end of the one or more teeth when the repositionable pin is positioned at the top vertical position, the bottom vertical position, or the intermediate vertical position.

7. The starting block pedal of claim 5, wherein the repositionable pin is configured to move along a vertical portion height, and position at the top vertical position, the bottom vertical position, or the intermediate vertical position along the vertical portion height.

8. The starting block pedal of claim 7, wherein the vertical portion comprises a first set of holes disposed along the vertical portion height, wherein the first set of holes is disposed between the vertical portion top end and the vertical portion bottom end, and wherein the repositionable pin is configured to engage with a hole of the first set of holes to position the repositionable pin at the top vertical position, the bottom vertical position, or the intermediate vertical position.

9. The starting block pedal of claim 3 further comprising an attachment mechanism configured to attach the retaining clip to the pedal body.

10. The starting block pedal of claim 9, wherein at least one of the horizontal portion or the vertical portion comprises a second set of holes along a horizontal portion height or a vertical portion height, and wherein the attachment mechanism is configured to attach the retaining clip to the pedal body via a first hole of the second set of holes.

11. The starting block pedal of claim 10, wherein the retaining clip is configured to reposition vertically along a pedal body height by reattaching the attachment mechanism via a second hole of the second set of holes.

12. The starting block pedal of claim 9, wherein the attachment mechanism comprises one or more screws.

13. The starting block pedal of claim 1 further comprising one or more additional repositionable pins that are configured to rest at a bottom portion of other slots of the plurality of slots.

14. The starting block pedal of claim 1, wherein the retaining clip is further configured to move away from the pedal body side surface to change a distance between the retaining clip and the pedal body.

15. The starting block pedal of claim 14, wherein the retaining clip is further configured to move away from the pedal body side surface via a spring mechanism.

16. A starting block pedal of a starting block comprising:

a pedal body;

a retaining clip attached to a pedal body side surface, wherein the retaining clip is configured to attach the starting block pedal to a rail of the staring block, and wherein the rail comprises a rail base, a plurality of slots, and teeth; and a repositionable pin configured to be disposed between a retaining clip body and the pedal body side surface, wherein the repositionable pin is configured to move vertically up or down along a retaining clip body longitudinal axis, and wherein the repositionable pin is configured to rest at a slot bottom portion associated with the plurality of slots, wherein the retaining clip is an inverted "L-shaped" clip having a horizontal portion and a vertical portion, and wherein the horizontal portion is configured to rest on a top end of one or more teeth, and the vertical portion is disposed a predetermined distance away from the pedal body side surface to form a gap that is configured to receive the one or more teeth.

17. The starting block pedal of claim 16, wherein the repositionable pin is configured to position at a top vertical position, a bottom vertical position, or an intermediate vertical position between the top vertical position and the bottom vertical position, and wherein the repositionable pin is configured to rest at the slot bottom portion when the repositionable pin is positioned at the top vertical position, the bottom vertical position, or the intermediate vertical position based on a slot height.

18. The starting block pedal of claim 17, wherein the horizontal portion is configured to rest on the top end of the one or more teeth when the repositionable pin is positioned at the top vertical position, the bottom vertical position, or the intermediate vertical position.

19. The starting block pedal of claim 17, wherein the vertical portion comprises a set of holes disposed along a vertical portion height, and wherein the repositionable pin is configured to engage with a hole of the set of holes to position the repositionable pin at the top vertical position, the bottom vertical position, or the intermediate vertical position.

20. A starting block pedal of a starting block comprising:

a pedal body;

a retaining clip attached to a pedal body side surface, wherein the retaining clip is configured to attach the starting block pedal to a rail of the starting block, and wherein the rail comprises a rail base, a plurality of slots, and teeth;

a repositionable pin configured to be disposed between a retaining clip body and the pedal body side surface, wherein the repositionable pin is configured to move vertically up or down along a retaining clip body longitudinal axis, and wherein the repositionable pin is configured to rest at a slot bottom portion associated with the plurality of slots; and an attachment mechanism configured to attach the retaining clip to the pedal body, wherein the retaining clip is configured to reposition vertically along a pedal body height by repositioning the attachment mechanism.

* * * * *